US005249094A

United States Patent [19]

Hayakawa et al.

[11] Patent Number: 5,249,094

[45] Date of Patent: Sep. 28, 1993

[54] PULSED-DC IONIZER

[75] Inventors: Ichiya Hayakawa, 4-21-13, Tsukushino, Machida-shi, Tokyo; Kazuo Nakamura, Urawa; Masanori Suzuki, Tokyo, all of Japan

[73] Assignees: Asahi Glass Company Ltd.; Techno Ryowa Ltd.; Ichiya Hayakawa, all of Tokyo, Japan

[21] Appl. No.: 673,078

[22] Filed: Mar. 21, 1991

[30] Foreign Application Priority Data

Mar. 22, 1990 [JP] Japan ..... 2-28209[U]

[51] Int. Cl.[5] ..... H05F 1/00

[52] U.S. Cl. ..... 361/229; 361/213; 361/220; 361/231

[58] Field of Search ..... 361/213, 220, 222, 229, 361/230, 231

[56] References Cited

U.S. PATENT DOCUMENTS

| | | | |
|---|---|---|---|
| 3,789,278 | 1/1974 | Bingham et al. | 361/229 |
| 4,086,650 | 4/1978 | Davis et al. | 361/229 |
| 4,227,234 | 1/1980 | Seanor et al. | 361/229 |
| 4,630,167 | 12/1986 | Huggins | 361/213 |
| 4,910,637 | 3/1990 | Hanna | 361/229 |
| 5,047,892 | 9/1991 | Sakata et al. | 361/231 |
| 5,057,966 | 10/1991 | Sakata et al. | 361/213 |

OTHER PUBLICATIONS

"Application of Microporous Glass(MPG) for Cleaning Particles in Gas & Liquid", Internatonal Committee of Contamination Control Societies (ICCCS), 10th International Symposium on Contamination Control (ICCCS90), Zurich, Switzerland, Sep. 10–14, 1990, Hayakawa et al., 3(1990) Nr. 4a, pp. 187–190.

*Primary Examiner*—Jeffrey A. Gaffin

*Attorney, Agent, or Firm*—Oblon, Spivak, McClelland, Maier & Neustadt

[57] ABSTRACT

An ionizer having a pair of electrodes for generating ions by corona discharge when a pulsed DC voltage is applied thereto, wherein each electrode is covered with a microporous glass tube. Release of fine particles is thereby substantially eliminated, the generation of ions not being decreased.

4 Claims, 3 Drawing Sheets

PULSED-DC IONIZER

BACKGROUND OF THE INVENTION

1. Field of the Invention

The present invention relates to a pulsed-DC ionizer.

2. Discussion of Background

Static charge has been problematic in many industrial fields. Particularly, electrostatic charges on silicon wafers or semiconductor devices have recently been a problem in clean room for semiconductor manufacturing, since they cause production yield loss. As high densification of semiconductor devices progresses, super high cleanliness is required for the production environment, and at the same time the electrostatic resistance of such semiconductor devices tends to be low, whereby the problem of production troubles due to static charge is increasingly problematic.

For controlling static charge, two methods are generally available. Namely, one method is to dissipate static charges by grounding the charged objects, and another method is to neutralize charges with ions. However, in the case of objects having high electric resistance such as wafers or semiconductor devices, it is difficult to dissipate charges by grounding. It has been reported that in such a case, it is effective to employ a method wherein bipolar ions are generated by an ionizer, and the charged objects are neutralized by such ions.

Ionizers which are commonly employed, may be classified into (1) an AC system, (2) a dual-DC system, and (3) a pulsed-DC system.

However, these ionizers have a problem that fine particles are released from the corona discharge electrodes, and they can not be used at a site where such fine particles cause a micro-contamination problem. In addition to such drawback, the above systems (1) and (2) have the following drawbacks.

(1) AC system

From a single electrode, positive ions and negative ions are generated in the same amounts at a frequency of 60 times (or 50 times) per second, whereby the apparent space charge becomes zero. Therefore, without airflow, ions do not move away from the electrodes. Even with airflow, since the time for a single operation of positive or negative ion generation is so short that generated positive and negative ions are still close to each other, and they are likely to be rejoined and neutralized in the vicinity of the electrodes. Accordingly, the coverage per unit is so narrow that if the objects to be eliminated static charges are apart from the unit more than e.g. 60 cm, no adequate effects will be obtained. Further, the ionization starting voltage usually varies depending upon the polarity of the applied voltage. Therefore, this system wherein ions are generated by alternate current, has a drawback that the amounts of the positive ions and the negative ions to be generated can not accurately be controlled.

(2) Dual-DC system

The dual-DC system is a system wherein positive and negative DC voltages are applied to the positive and negative electrodes, respectively, to constantly generate prescribed quantities of positive and negative ions from the respective electrodes. In this system, monopolar ions are continuously generated, whereby the space charge density between the electrodes is very high, and ions continue to widely diffuse due to the repulsion of ions of the same polarity even without airflow. However, since the space charge density between the electrodes is so high that if the electrodes are close to each other, spark discharge is likely to take place between the electrodes, whereby the electrodes are likely to be worn out substantially, and the balance in the generation of bipolar ions tends to be destroyed, and there will be a danger of charging with excess ions.

(3) Pulsed-DC system

As opposed to the above systems (1) and (2), the pulsed DC system has a pair of positive and negative electrodes to which positive and negative DC voltages are alternately applied at prescribed intervals to generate positive and negative ions from the respective electrodes alternately. The periods of time during which the voltages are applied and the intervals between the application of the voltages can be adjusted to create a space charge to some extent and to facilitate the diffusion of ions. Therefore, this system has a feature that the coverage per unit is wide as compared with other systems. Further, this system of generating ions by DC pulses has another feature where the amount of the ions to be generated and the ratio of the positive and negative ions can be easily controlled by adjusting the applied voltages, the time applied at constant voltage and the time intervals between applied voltages. Therefore, the static charge eliminating time can be optionally controlled by adjusting the amount of ions to be generated and the ratio of the positive and negative ions depending upon the position of the object to be eliminated static charges, whereby it is possible to prevent charging due to an unbalance in the generation of the positive and negative ions. Further, this system can be applied not only to the semiconductor manufacturing but also to a process for e.g. printing or film forming, wherein when the polarity of the charged object is known, it is possible to generate ions of opposite polarity predominantly.

Thus, the pulsed-DC system is most effective for controlling the overall static charge over the entire space along the flow of products in a production plant including stages of assembling, inspection, storage, transportation (packaging), etc. and for maintaining a safe production environmental level, in the production plant of the electronic appliances and parts where many insulating materials and non-grounded metal materials are brought in. However, particle generation from the corona-discharge electrodes has been a problem.

An AC system has already been proposed in which a needle-shaped tungsten electrode covered with a thin quartz tube is employed, an AC voltage (50 Hz–100 Hz) is applied thereto, then the polarity of the applied voltage is reversed before air ions having a polarity opposite to the applied voltage surround the quartz tube, and the electric field strength at the forward end of the electrode is maintained at a level of at least 30 kV/cm, so that positive and negative ions are generated by AC corona. However, as mentioned above, in an AC system, the positive and negative ions tend to rejoin to each other in the vicinity of the electrode whereby the amount of ions decreases, and in order to maintain the necessary amount of ions, it used to be required to increase the number of electrodes per unit.

In the case of a DC system, if the electrode is covered with a quartz tube, at the initial stage when the voltage is applied, air will be ionized by the electric field at the forward end of the electrode, whereby positive and negative ions will be generated. However, upon expiration of a certain time after the application of the voltage (e.g. about 0.1 second in an airflow of 0.3 m/sec), air ions having a polarity opposite to the applied voltage will surround the quartz tube, whereby the electric field strength at the forward end of the electrode will be weakened, and continuous generation of ions can not be expected.

SUMMARY OF THE INVENTION

It is the object of the present invention to overcome the above mentioned problems inherent to the prior art and to provide an ionizer of pulsed-DC system which is free from release of fine particles from the electrodes and which is substantially free from a decrease in the generation of ions.

The present invention provides an ionizer having a pair of electrodes for generating ions by corona discharge when a pulsed DC voltage is applied thereto, wherein each electrode is covered with a microporous glass tube.

DETAILED DESCRIPTION OF THE PREFERRED EMBODIMENTS

Figure 1:
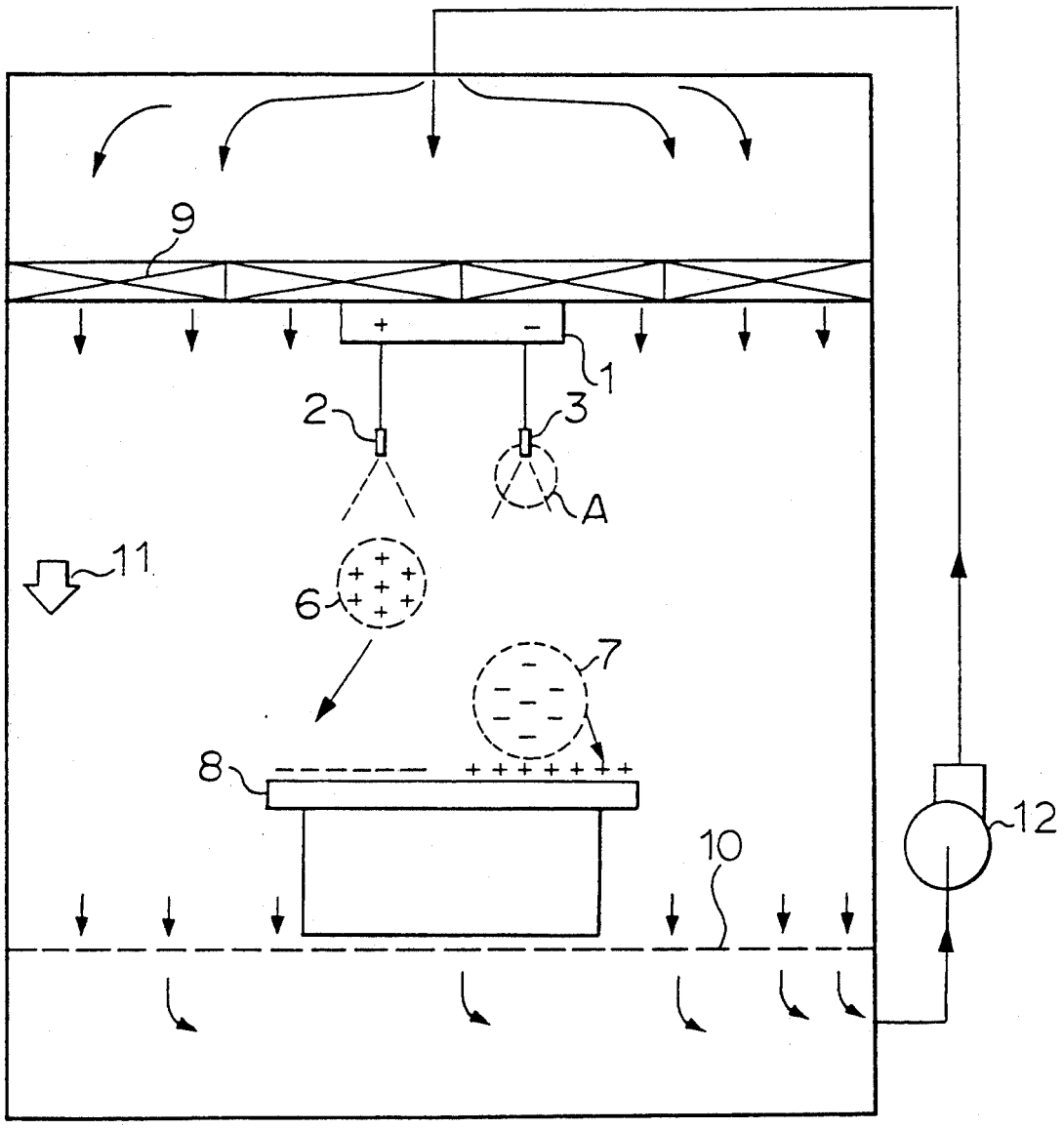
FIG. 1 is a schematic view of the ionizer of the present invention.
Figure 2:
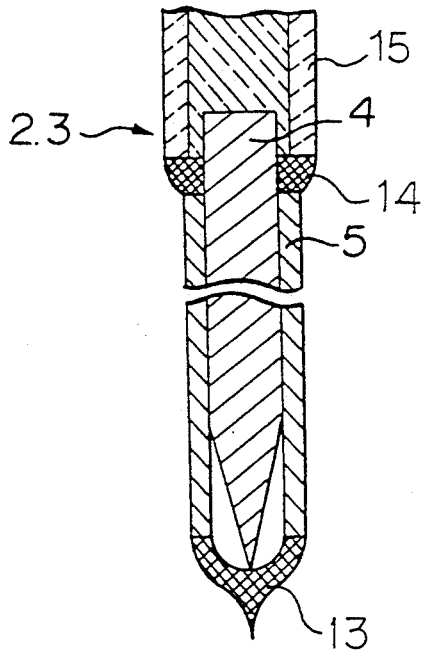
FIG. 2 is an enlarged cross sectional view of portion A in FIG. 1.

FIG. 1 is a schematic view of the ionizer of the present invention, and FIG. 2 is an enlarged cross sectional view of portion A of FIG. 1. As illustrated, the ionizer 1 has a positive electrode 2 and a negative electrode 3. The respective electrodes are electrically connected to the positive electrode and the negative electrode of a pulsed DC power supply (not shown), so that a positive voltage and a negative voltage are applied to the positive electrode and the negative electrode alternately at prescribed intervals. The applied voltage is at a level sufficient to cause corona discharge and at a level of from a few kV to a few tens kV in usual clean rooms.

Each of these electrodes 2 and 3 comprises a downwardly needle-shaped electrode body 4 and a microporous glass tube 5 covering the electrode body 4. The electrode body may be made of such material as tungsten or stainless steel, although the material is not particularly limited.

The microporous tube 5 preferably has pores with pore sizes of from 20 to 200,000 Å. If the pore sizes are too small, the generation of ions tends to be low. On the other hand, if the pore sizes are too large, ultrafine metal particles resulting from wearing of the electrode body are likely to pass therethrough and be released out of the microporous tube.

The inner diameter of the microporous glass tube is preferably as small as possible so long as electrode body can be inserted therein without trouble, so that ions can efficiently be generated.

The wall thickness of the microporous glass tube is preferably as thin as possible, so that ions can efficiently be generated.

The glass composition constituting such microporous glass tube may, for example, be as follows.

Namely, it may comprise from 60 to 95% by weight of $SiO_2$, from 3 to 20% by weight of $B_2O_3$, from 0.3 to 15% by weight of $Al_2O_3$, from 0.1 to 9% by weight of $R_2O$ (wherein R is an alkali metal), from 0.1 to 5% by weight of CaO, from 0.1 to 10% by weight of $MgO+SrO+BaO$ and from 0 to 20% by weight of $ZrO_2+TiO_2$.

In the present invention, for example, a positive voltage is applied to the positive electrode 2 for 0.5 second, then a negative voltage is applied to the negative electrode 3 for 0.5 second, and this cycle is repeated, so that positive ions 6 and negative ions 7 are generated at intervals of about 0.5 second.

These ions are transported by a unidirectional down airflow and neutralize static charges on a charged object 8 in the clean room.

Reference numeral 9 indicates a filter which cleans the circulating airflow suctioned by a fan 12 from below the floor 10 and supplies the cleaned airflow to the electrodes 2 and 3. An arrow 11 indicates a unidirectional down airflow.

Referring to FIG. 2, reference numeral 13 indicates a weld, numeral 14 indicates a sealing material and numeral 15 indicates a supporter for the electrode.

Now, the present invention will be described in further detail with reference to a specific Example. However, it should be understood that the present invention is by no means restricted by such a specific example.

The forward end of a tungsten rod having a diameter of 2 mm was formed into a needle-shape, and such a tungsten rod was covered with a microporous glass tube having an inner diameter of 3 mm to form an electrode structure as shown in FIG. 2.

This microporous tube had an average pore size of 3,200 Å.

This electrode was used for each of the positive and negative electrodes for an ionizer. With such an ionizer, 16 kV to the positive electrode and 19 kV to the negative electrode were alternately applied, and ion concentrations in the ambient air below the ionizer were measured, whereby each of the positive ion concentration and the negative ion concentration was 250,000 ions/cc. This ion concentration was substantially the same as in the case where no microporous glass tube was installed, thus indicating that generation of ions did not decrease by the installation of the microporous glass tube.

Figure 3:
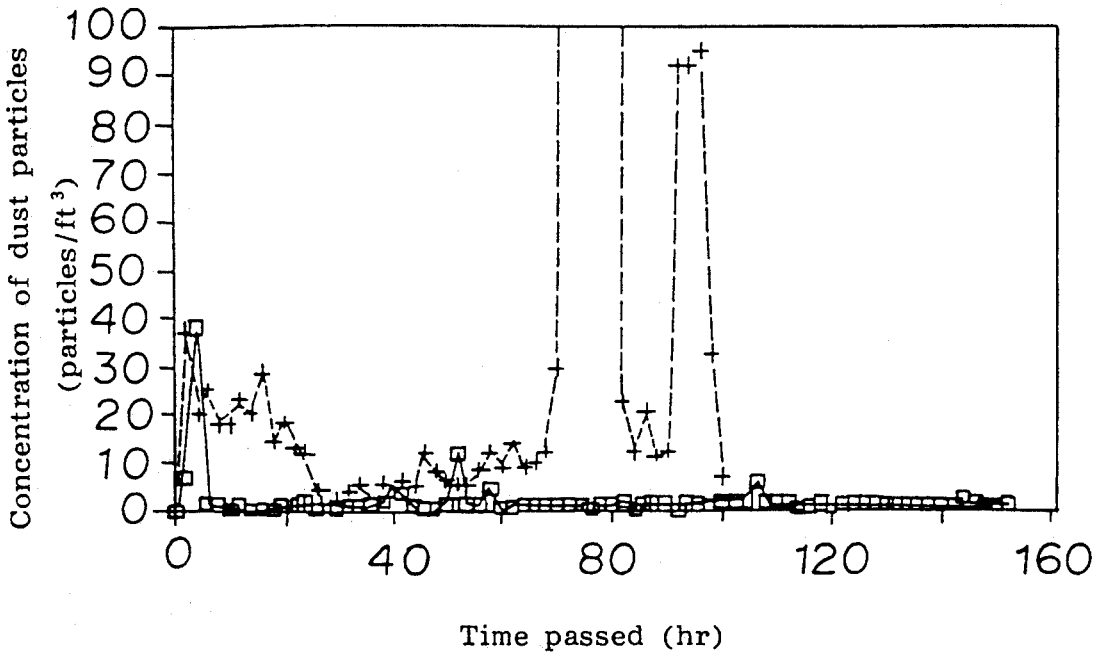
FIG. 3 is a graph showing the concentration of fine particles.

Then, the ionizer of the present invention was continuously used, and the concentration of fine particles in the atmosphere was measured, whereby as shown by symbol mark □ in FIG. 3, no substantial particles with particle sizes of 0.03 μm or larger were detected in the atmosphere even when the ionizer was operated continuously for 160 hours.

Whereas, in a case where no microporous glass tube was used, a few thousands of fine particles per $ft^3$ were observed in the atmosphere upon expiration of about 70 hours, as shown by symbol mark + in FIG. 3.

Further, in a case where a usual glass tube was used instead of the microporous glass tube, no substantial generation of ions was observed.

The ion concentration and the fine particle concentration were measured as follows by permitting the air passed through the filter to descend in a laminar or unidirectional flow at a rate of 0.24 m/sec and disposing electrodes therein.

Measurement of ionconcentration

The ion concentration was measured by setting an air ion density meter (ISI AIDM 110 ISI, manufactured by Ion Systems Inc.) at about 1.3 m below the forward ends of the electrodes.

Fine particle concentration

The concentration of fine particles was measured by means of a particle counter (TSI CNC 3020 TSI, manufactured by Thermal Systems Inc.) by suctioning the atmosphere in the vicinity of the electrodes.

As described in the foregoing, ionizers are classified into an AC-system, a dual DC system and a pulsed-DC system according to the difference in the power supply for corona discharge, and the pulsed-DC system is considered to be best of all. However, even the pulsed-DC system has a problem that fine particles are generated from the electrodes. In an AC system, it is possible to cover the electrode by a quartz tube and thereby to prevent release of fine particles and to generate ions. However, in a DC system it has been considered difficult to continuously discharge at the surface of a quartz tube.

In the present invention, using a microporous glass tube and adopting a pulsed-DC system, it has been made possible to continuously generate ions without reducing the amount of ions by covering the electrodes with microporous glass tubes.

What is claimed is:

1. An ionizer having a pair of electrodes for generating ions by corona discharge when a pulsed DC voltage is applied thereto, wherein each electrode is covered with a microporous glass tube, wherein the microporous glass tube has pores with pore sizes within the range of from 20 to 200,000 Å.

2. The ionizer according to claim 1, wherein the microporous glass tube is made of glass comprising from 60 to 95% by weight of $SiO_2$, from 3 to 20% by weight of $B_2O_3$, from 0.3 to 15% by weight of $Al_2O_3$, from 0.1 to 9% by weight of $R_2O$ (wherein R is an alkali metal), from 0.1 to 5% by weight of CaO, from 0.1 to 10% by weight of MgO +SrO+BaO and from 0 to 20% by weight of $ZrO_2+TiO_2$.

3. The ionizer according to claim 1, wherein each electrode is needle-shaped.

4. The ionizer according to claim 1, wherein each electrode is made of tungsten or stainless steel.

* * * * *